US005744048A

United States Patent [19]

Stetler

[11] Patent Number: 5,744,048

[45] Date of Patent: Apr. 28, 1998

[54] CLOG RESISTANT STORM DRAIN FILTER

[75] Inventor: Christopher C. Stetler, South Lake Tahoe, Calif.

[73] Assignee: Storm Water Systems, Inc., Reno, Nev.

[21] Appl. No.: 785,760

[22] Filed: Jan. 18, 1997

Related U.S. Application Data

[60] Provisional application No. 60/012,615, Mar. 1, 1996.

[51] Int. Cl.[6] ..... C02F 1/28; E03F 1/00

[52] U.S. Cl. ..... 210/803; 210/806; 210/807; 210/164; 210/166; 210/232; 210/237; 210/282; 210/314; 404/4

[58] Field of Search ..... 404/2, 3, 4, 5; 210/162, 163, 164, 165, 166, 282, 299, 314, 460, 489, 232, 237, 803, 806, 807

[56] References Cited

U.S. PATENT DOCUMENTS

| | | | |
|---|---|---|---|
| 2,615,526 | 10/1952 | Lane | 210/164 |
| 4,419,232 | 12/1983 | Arntyr et al. | 210/164 |
| 4,720,209 | 1/1988 | Iams | 210/165 |
| 4,776,722 | 10/1988 | Gaudin | 210/164 |
| 4,906,381 | 3/1990 | Barbaro | 210/660 |
| 4,935,132 | 6/1990 | Schaier | 210/163 |
| 5,051,175 | 9/1991 | Wallzak et al. | 210/166 |
| 5,133,619 | 7/1992 | Murfae et al. | 404/4 |
| 5,223,154 | 6/1993 | MacPherson, Jr. et al. | 210/163 |
| 5,232,587 | 8/1993 | Hegemier et al. | 210/162 |
| 5,322,629 | 6/1994 | Stewart | 210/767 |
| 5,372,714 | 12/1994 | Logue, Jr. | 210/164 |
| 5,397,464 | 3/1995 | Hannon | 210/163 |
| 5,403,474 | 4/1995 | Emery | 210/163 |
| 5,405,539 | 4/1995 | Schneider | 210/163 |
| 5,480,254 | 1/1996 | Autry et al. | 404/2 |
| 5,486,287 | 1/1996 | Murphy et al. | 210/164 |
| 5,507,944 | 4/1996 | Friedland et al. | 210/162 |
| 5,562,819 | 10/1996 | Turner, Jr. et al. | 210/163 |
| 5,632,889 | 5/1997 | Tharp | 210/166 |

OTHER PUBLICATIONS

Fossil Filter Sales Brochure, Mar. 1995, 4 pages by Kristar Ent., Inc.

Hydro–Kleen Filter Systems Sales Brochure, Nov. 1996, 1 page (2–Sided) by Bamcon Engineering.

Stream Guard Catch Basin Insert Sales Brochure, Jan. 1996, 1 page (2–Sided) by Foss Environmental.

Gullywasher Sales Brochure, Feb. 1995, 4–Pages Total (2–Sided) by Aqua–Net, Inc.

Evaluation of Comm. Available Catch Basin Inserts For The Treatment of Storm–Water Runoff From Developed Sites, Apr. 1995, 100–Pages (2–Sided) by The Catch Basin Insert Committee.

*Primary Examiner*—Neil McCarthy
*Assistant Examiner*—Theodore M. Green

[57] ABSTRACT

A removable storm drain filter to be used in combination with an absorbent media, and a catch basin having grated inlet and standpipe outlet to remove pollutants carried in surface drainage. The storm drain filter is designed to fit within a catch basin, below the grated inlet, and upon the upward terminus of a vertical stand pipe. A filtration vessel (50) is provided to contain absorbent media and to provide a primary flow path through the absorbent media and a secondary flow path (bypass) for high flows. The filter includes a cover plate (70), structurally supported by and above the filtration vessel, to prevent deposition of sediment upon the absorbent media and to prevent direct striking of the absorbent media by influent storm water. The storm drain filter further includes a floatables screen (60) to prevent clogging of the absorbent media by floating debris such as leaves, pine needles, and cigarette butts. A lift handle (80) is provided to facilitate handling of the fully assembled filter by a human being without special equipment.

13 Claims, 14 Drawing Sheets

BEST AVAILABLE COPY

BEST AVAILABLE COPY

BEST AVAILABLE COPY

BEST AVAILABLE COPY

CLOG RESISTANT STORM DRAIN FILTER

This application is based upon provisional application 60/012,615, filed Mar. 1, 1996.

BACKGROUND—FIELD OF INVENTION

This invention relates to an apparatus and method for treating storm water runoff within a storm drain catch basin.

BACKGROUND—DESCRIPTION OF PRIOR ART

Although storm water runoff is part of the natural hydrologic cycle, human activities, particularly urbanization, can result in significant and problematic changes to the natural hydrology of an area. Under conditions of minimal urbanization, water percolates through pervious surfaces in which soil filtration and biological action remove pollutants. During urbanization, pervious surfaces are converted to impervious surfaces and, as a result, there is a reduction in the volume of percolated runoff and an associated reduction in the environment's capacity to assimilate pollutants. In addition, since nearly all of man's activities produce byproducts, increases in urban populations are accompanied by increases in the variety and amounts of pollutants generated. As a result, when rain falls on, and drains through urbanized areas (freeways, industries, construction sites, and neighborhoods) it picks up a multitude of pollutants. Typically, the pollutants in runoff, both visible and invisible, enter a network of channels and underground pipes called storm water conveyance systems. Such systems often convey the polluted runoff to creeks, rivers, lakes, estuaries, bays, and oceans. In short, urbanization results in a dramatic increase in the volume, velocity, and especially the pollutant load carried by storm water runoff to receiving waters. Important pollutant categories found in urban runoff include, but are not limited to: metals, pathogens, oil and grease, sediment, and nutrients.

To address a growing urban runoff problem, the United States Congress added Section 402(p) to the federal Clean Water Act in 1987. Section 402(p), and the federal regulations that implement it (40 Code Federal Regulations 122, 123, 124, November 1990), require National Pollutant Discharge Elimination System (NPDES) permits for storm water runoff discharges from municipalities and industries, including construction. These NPDES permits authorize the discharge of storm water only, and prohibit pollutant and non-storm water discharges into storm water conveyance systems. The overall objective of the NPDES storm water program is to eliminate or reduce the discharge of pollutants into storm water.

The most obvious and effective way to prevent the discharge of pollutants to receiving waters is pollution prevention. Pollution prevention is the common sense notion of trying to prevent or reduce pollution at the source, before it is created. Pollution prevention is accomplished by seeking alternate materials, production processes, or products that result in wastes with a lower volume or lower toxicity. To eliminate pollutants in storm water runoff, one can either treat the storm water to remove pollutants, or one can prevent the runoff from becoming polluted in the first place. Because of the overwhelming volume of storm water and the costs normally associated with pollutant removal, pollution prevention makes the most sense. Pollution prevention is accomplished by way of Best Management Practices (BMPs) which are defined as any program, technology, process, siting criteria, operating method, or device that controls, prevents, removes, or reduces pollution.

Although the best approach is to prevent pollution entirely by preventing pollutant generation, sometimes complete elimination of pollutants is not feasible. Once pollutants are generated, they must be controlled. There are two ways to control pollutants in urban runoff: (1) source reduction BMPs, and (2) treatment or structural BMPs. Source reduction BMPs are operational practices that prevent pollution by reducing potential pollutants at the source. They typically do not require construction. Two source reduction BMPs that are common to industrial, construction, and municipal applications are good housekeeping practices (cleaning up and immediately disposing of wastes properly) and education (employee and public).

The second type of BMPs are called treatment or structural control BMPs. As the name suggests, these are treatment methods used to remove pollutants from storm water. Although treatment controls are structural in nature, more costly than source reduction BMPs, and usually require maintenance, they can be quite effective. This is especially true when used with source control BMPs. Examples of treatment controls include infiltration systems, retention basins, sand/oil interceptors, and catch basins. Catch basins are intended to trap large settleable solids by means of a settling zone or sump below the catch basin outlet. Catch basins typically have a grated inlet at grade with the drained surface.

Of particular concern to designers of structural BMPs is the intermittent nature of storm events and the "first flush" phenomenon. Storm events and the resulting storm water flows are sporadic and usually show seasonal peaks. Pollutant concentrations in storm water, in addition to being dependent on localized factors, correlate with rainfall interval spacing. In other words, the longer the span between storms, the greater pollutant concentration when a rainfall event occurs. This is due to the continual buildup of pollutants on the drained surfaces over time. Thus, potential damage to receiving waters is greater after a prolonged dry spell. These "first flush" events occur when receiving streams are at low flow and the dilution of pollutants from storm water is minimal; consequently, these events cause the greatest impacts on receiving water quality. Generally, the first flush occurs during the first half-hour or so, when the rain is flushing the amassed buildup of pollutants that have accumulated during the interval since the preceding storm, and pollution loading is highest. Even if the storm lasts several hours or more, contamination levels during the remainder of the event are usually much lower than during the first half-hour or so.

Common pollutants associated with storm water include sediment, and oil and grease. Excessive sediment can be detrimental to aquatic life (primary producers, benthic invertebrates and fish) by interfering with photosynthesis, respiration, growth, and reproduction. In addition, the sediment can transport other pollutants that are attached to it including nutrients, trace metals, and hydrocarbons. Oil and grease contain a wide array of hydrocarbon compounds, some of which are toxic aquatic organisms at low concentrations. The main sources of oil and grease are leakage from engines, spills at fueling stations, overfilled tanks, restaurant grease traps, and waste oil disposal.

Growing concern over the impact of pollutants that are washed from paved areas in the urban environment and stringent federal (see above), state, and local requirements have prompted regulatory agencies to examine new methods of storm water treatment and structural BMPs. Similarly, the private sector has recognized the need to develop new products and services that will help businesses and municipalities reduce their contribution to water pollution problems and meet environmental regulations. Among these products are devices designed to fit beneath storm drain inlets for purposes of removing pollutants carried in storm water runoff. These devices are commonly referred to as "catch basin inserts". Catch basin inserts are primarily used to remove sediment, and/or oil and grease from runoff.

Common features of catch basin inserts include the following: (1) a structure that contains the treatment system; (2) a means of supporting the structure beneath a grated drain or catch basin inlet (typically the structure is suspended from the grate or grate frame); (3) one or more treatment mechanisms that include sedimentation, filtration, gravitational separation of oil and water, and/or absorption of oil and grease by use of an absorbent media; (4) a primary outlet for treated water; and (5) a secondary or high-flow outlet through which water that exceeds the treatment capacity of the system may escape. Several catch basin inserts are commercially available at this time; however, these products share several design flaws that limit their treatment capacity and effectiveness:

(1) Of the inserts that include an absorbent means for removing oil and grease (such as the FOSSIL FILTER™ by Krystar Enterprises, Inc., the HYRDO-KLEEN™ filter system by BAMCON Engineering, Inc., and the GULLYWASHER by Aqua-Net, Inc.), one major design flaw is the hydraulic path through the insert. With the aforementioned inserts, runoff falls directly upon the insert (sometimes directly upon the absorbent media); consequently, sediment and debris (such as leaves, pine needles, and cigarette butts) carried in the runoff are deposited upon the treatment area. Without frequent maintenance, accumulated sediment and debris will eventually clog the insert. A means to remove sediment and debris prior to passing runoff through the absorbent media is necessary.

(2) Current designs (such as the FOSSIL FILTER™ and the GULLYWASHER) provide no means to prevent direct striking of the media by influent runoff. This condition can lead to scouring and disruption of the media. Some sort of energy dissipation is needed between the grated inlet and the absorbent media.

(3) Existing insert designs lack a true bypass system to convey flows that exceed the flow capacity through the absorbent media, without disruption of the media. Overflow areas are commonly an integral part of the treatment area, and as such, they do not provide sufficient protection of the treatment area during high flows. The use of a bypass that limits the total flow to the treatment area is needed.

(4) Another flaw with existing inserts is that they are installed in a way that provides little, or no protection of the catch basin sump. With existing inserts, accumulated sediments within the sump are highly susceptible to re-suspension (even at low flow rates). This re-suspension is caused by the energy of water exiting the catch basin through a lateral outlet. An alternate method of installation is necessary to create a more stagnant settling zone within the catch basin, and to take advantage of the sediment storage volume provided by the catch basin sump.

In October 1995, the Catch Basin Insert Committee (CBIC) released a report titled, "Evaluation of Commercially Available Catch Basin Inserts for the Treatment of Stormwater Runoff from Developed Sites." The CBIC is comprised of representatives from the following agencies: King County Surface Water Management Division, King County Department of Metropolitan Services, Snohomish County Surface Water Management Division, Seattle Drainage and Wastewater Utility, and the Port of Seattle. The intent of the October 1995 report was to provide general information on the state, and efficiency of catch basin inserts. The above-listed design flaws are consistent with the findings of the CBIC, as presented in their October 1995 report.

The following references represent the most closely related prior art patents of which the inventor is aware: (1) U.S. Pat. No. 4,419,232 to Arntyr, et al. (1983) discloses a filter that hangs below a grated storm drain inlet, and functions to separate and collect particulate impurities, oil, and other liquid impurities passing through the grating; (2) U.S. Pat. No. 4,935,132 by Schaier (1990) discloses a drain pipe filter to be placed within a drain pipe and functions to absorb oily contaminants exiting a storm drain; (3) U.S. Pat. No. 5,133,619 to Murfae, et al. (1992) discloses a storm water filter comprising a removable metal filter basket housed in a basin disposed upstream from a conventional storm water receiving basin; (4) U.S. Pat. No. 5,232,587 to Hegemier et al. (1993) discloses a filter to be placed within a storm sewer inlet, near the inlet, to prevent the entrance of litter, debris, and sediment into the storm water conveyance system; (5) U.S. Pat. No. 5,372,714 to Logue, Jr. (1994) discloses a bag (filter) that hangs below the grated inlet to a catch basin, and functions to collect particulate impurities passing through the grated inlet; (6) U.S. Pat. No. 5,403,474 to Emery (1995) discloses a filter to be located at the curb inlet to a storm water conveyance system, and functions to capture sediment at the curb inlet; (7) U.S. Pat. No. 5,405,539 to Schneider (1995) discloses a system to be assembled within a catch basin for purposes of enhancing sedimentation within the catch basin; (8) U.S. Pat. No. 5,480,254 to Autry, et al. (1996) discloses a filter that is placed above a grated drain or catch basin inlet and functions to prevent sediment and other debris from entering newly constructed storm drains.

OBJECTS AND ADVANTAGES

With the foregoing considerations in mind, several objects and advantages of my storm drain filter and its method of use are:

(a) to provide a removable storm drain filter that may be used in combination with an absorbent media and a catch basin having grated inlet and standpipe outlet, to enhance sedimentation within the catch basin and to remove oil and grease carried in surface drainage;

(b) to provide a storm drain filter that is particularly designed to treat the first flush from paved areas;

(c) to provide a storm drain filter that directs influent sediment away from the absorbent media, and into an area where settling may occur;

(d) to provide a storm drain filter that prevents accumulation of floating debris upon the absorbent media;

(e) to provide a storm drain filter that dissipates energy of influent runoff between the grated inlet and the absorbent media, so as to prevent scouring and disruption of the absorbent media;

(f) to provide a storm drain filter that can convey flows that exceed the flow capacity through the absorbent media without disruption of the media.

Further objects and advantages are to provide a storm drain filter that is simple to use and inexpensive to manufacture, that is easily installed and maintained, and that is durable and corrosion resistant. Still further objects and advantages are to provide a storm drain filter that may be installed upon a standpipe, so as to provide a more stagnant settling zone within the catch basin to prevent re-suspension of accumulated sediment in the catch basin sump. Additional objects and advantages will become apparent from a consideration of the ensuing description and drawings.

BRIEF DESCRIPTION OF THE DRAWINGS

In the drawings, closely related figures have the same number but different alphabetic suffixes.

REFERENCE NUMERALS IN DRAWINGS

Underlined numerals refer to an entire assembly of connected elements.

| | | | |
|---|---|---|---|
| 50 | Filtration vessel | 51A | Spoke |
| 51B | Spoke | 51C | Spoke |
| 51D | Spoke | 52 | Outer cylinder |
| 53 | Circular collar | 54 | Inner cylinder |
| 55A | Vertical bar | 55B | Vertical bar |
| 55h | Hole | 56 | Horizontal bar |
| 58 | Perforated bottom | 59 | Gasket |
| 60 | Perforated lid/floatables screen | 61 | Perforated lid |
| 61h | Bolt hole | 62A | Screen support |
| 62B | Screen Support | 62C | Screen support |
| 62D | Screen Support | 64 | Floatables screen |
| 65 | Screw | 66 | Washer |
| 67 | Nut | | |
| 70 | Cover plate | 71 | Plate |
| 72 | Aperture | 73A | Cover plate support |
| 73B | Cover plate support | | |
| 80 | Lift handle | 81 | Rod |
| 82 | End washer | 83 | Clip hole |
| 84 | Clip | | |
| 90 | Storm drain catch basin with grated inlet | | |
| 100 | Standpipe outlet | | |

SUMMARY

My removable storm drain filter, and its method of use, enhance sedimentation and the removal of oil and grease within a storm drain catch basin. Removal of oil and grease is accomplished by passing storm water through an oleophylic and hydrophobic media. The present design eliminates, or at least significantly reduces several problems encountered with existing storm drain filters (also referred to as catch basin inserts) by providing: (1) sedimentation prior to passing storm water through absorbent media; (2) dissipation of energy away from the absorbent media; (3) a true bypass that permits the passage of high flows without disruption of the absorbent media; (4) hydraulic control to prevent scouring of absorbent media; and (5) protection of accumulated sediments within the catch basin sump. In addition, my storm drain filter is easy to install, remove, and maintain by a human being without special equipment.

DESCRIPTION

FIGS. 1 to 8

Figure 1:
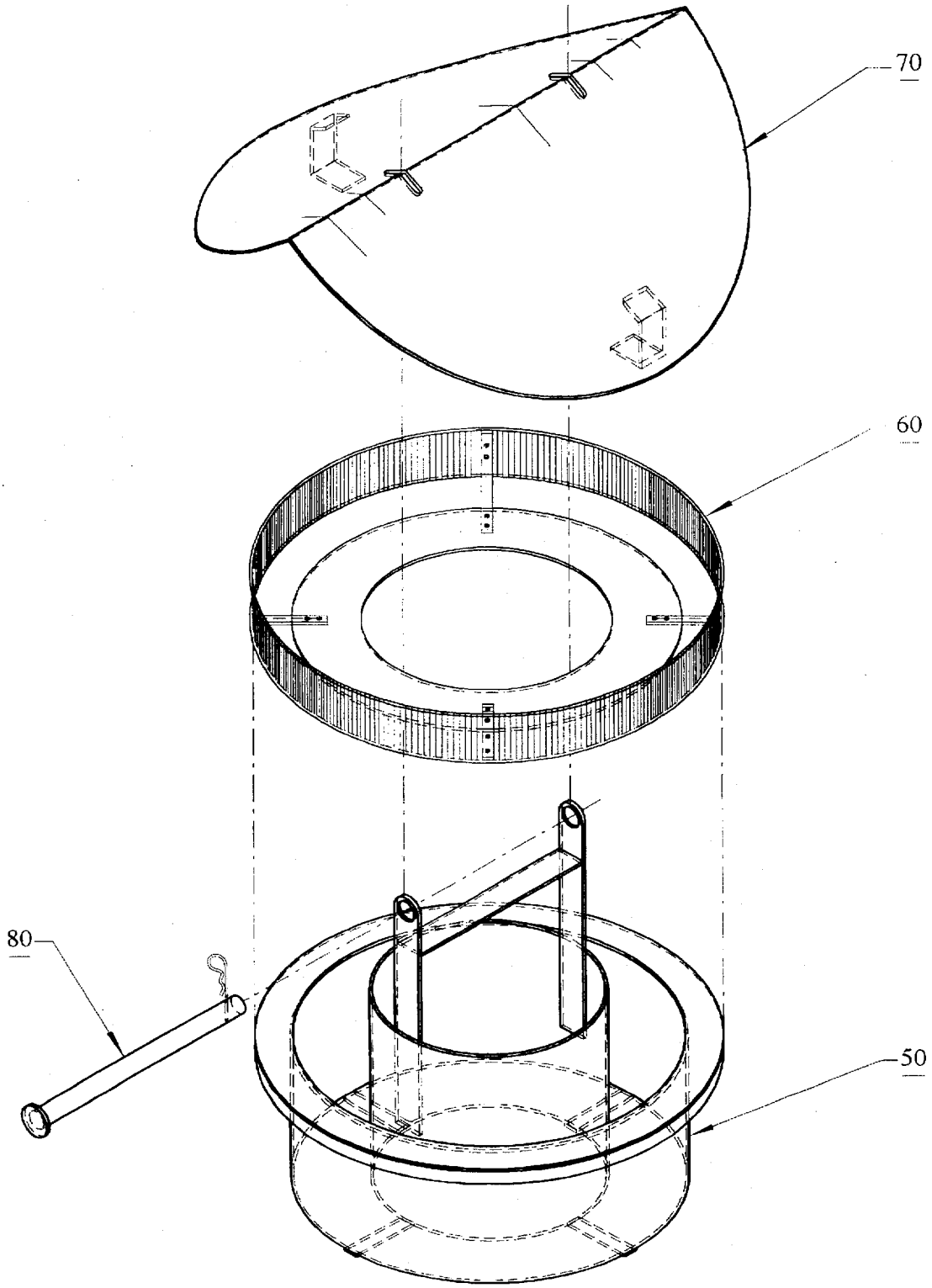
FIG. 1 shows the primary components of the storm drain filter in exploded view.
Figure 2:
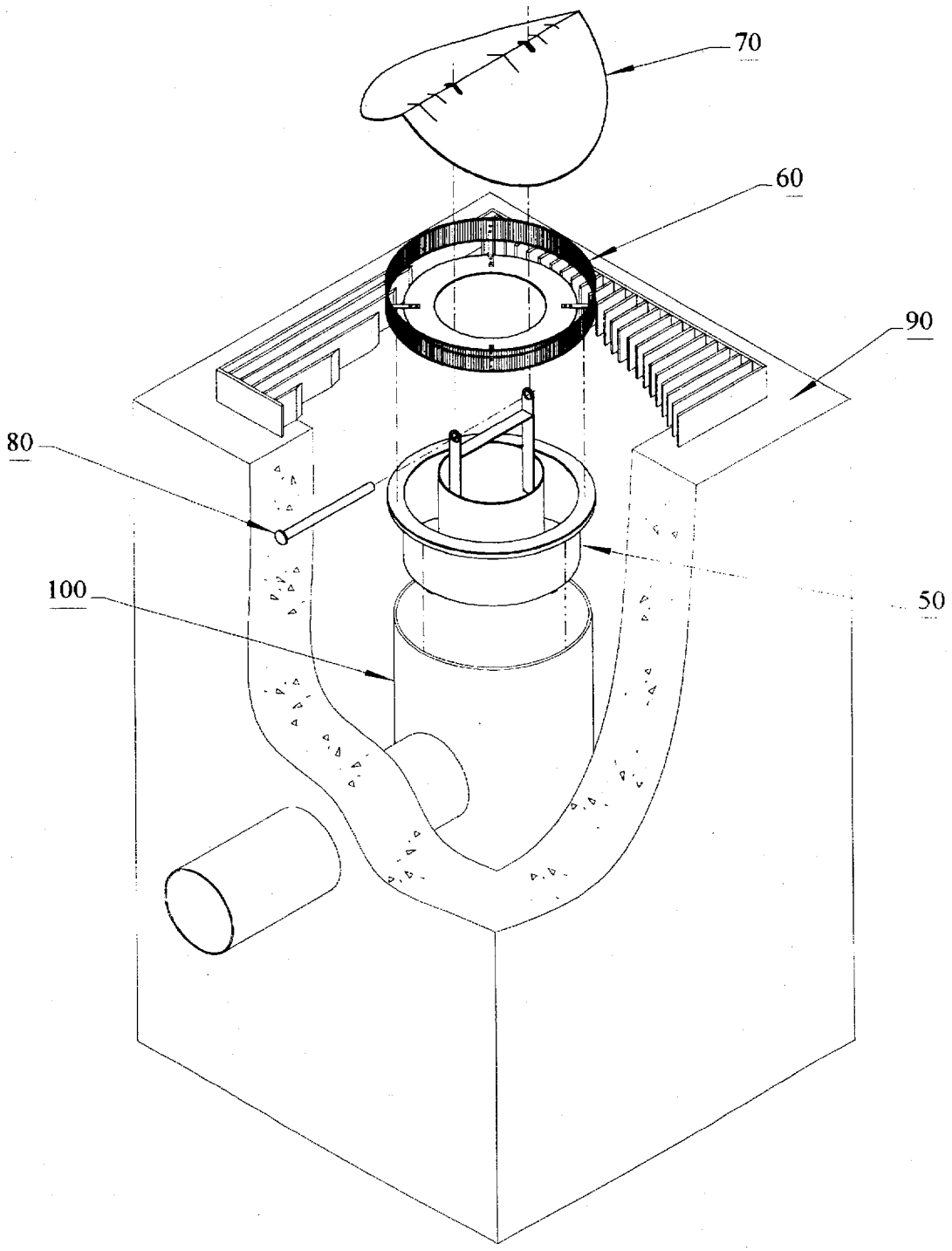
FIG. 2 shows a typical installation of the storm drain filter in a catch basin with grated inlet and standpipe outlet.
Figure 3:
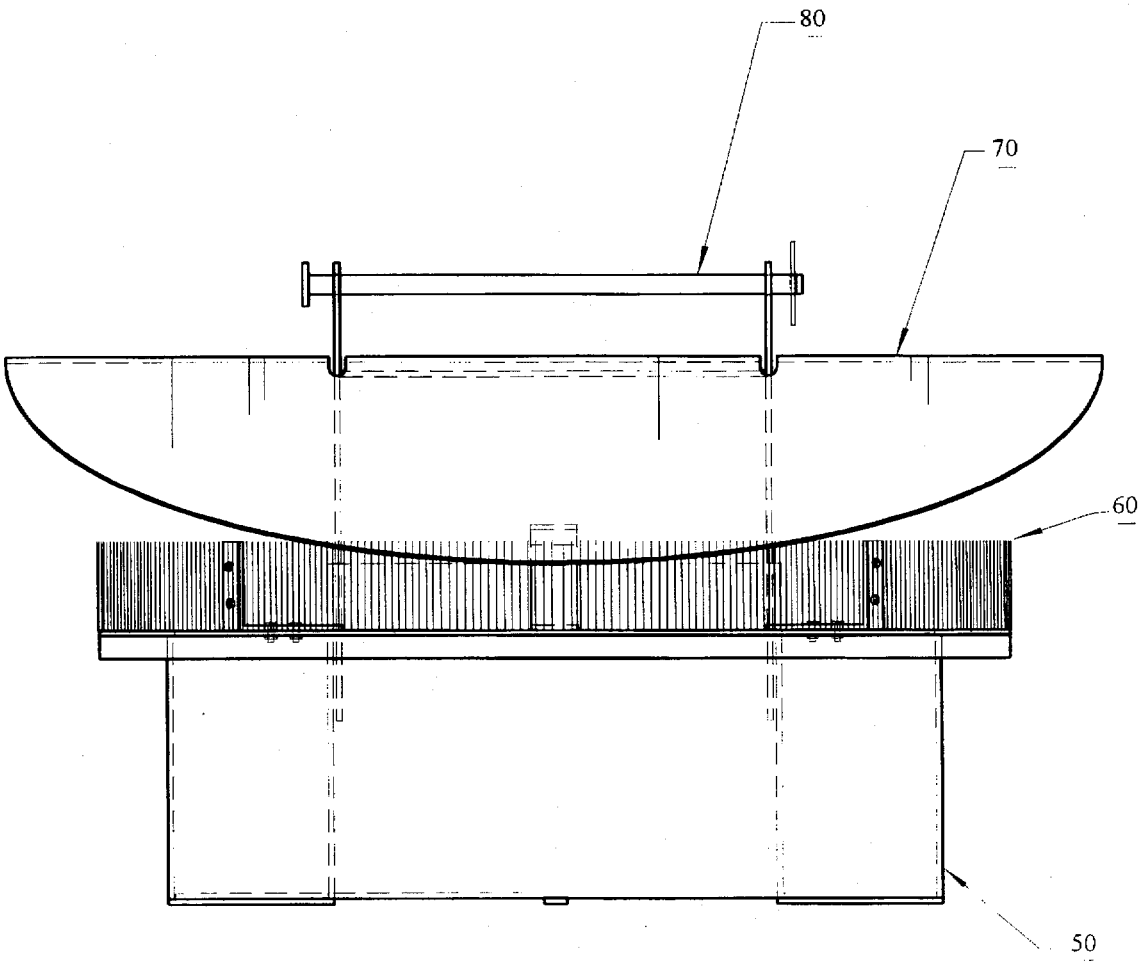
FIG. 3 shows a side view of the fully assembled storm drain filter.
Figure 4:
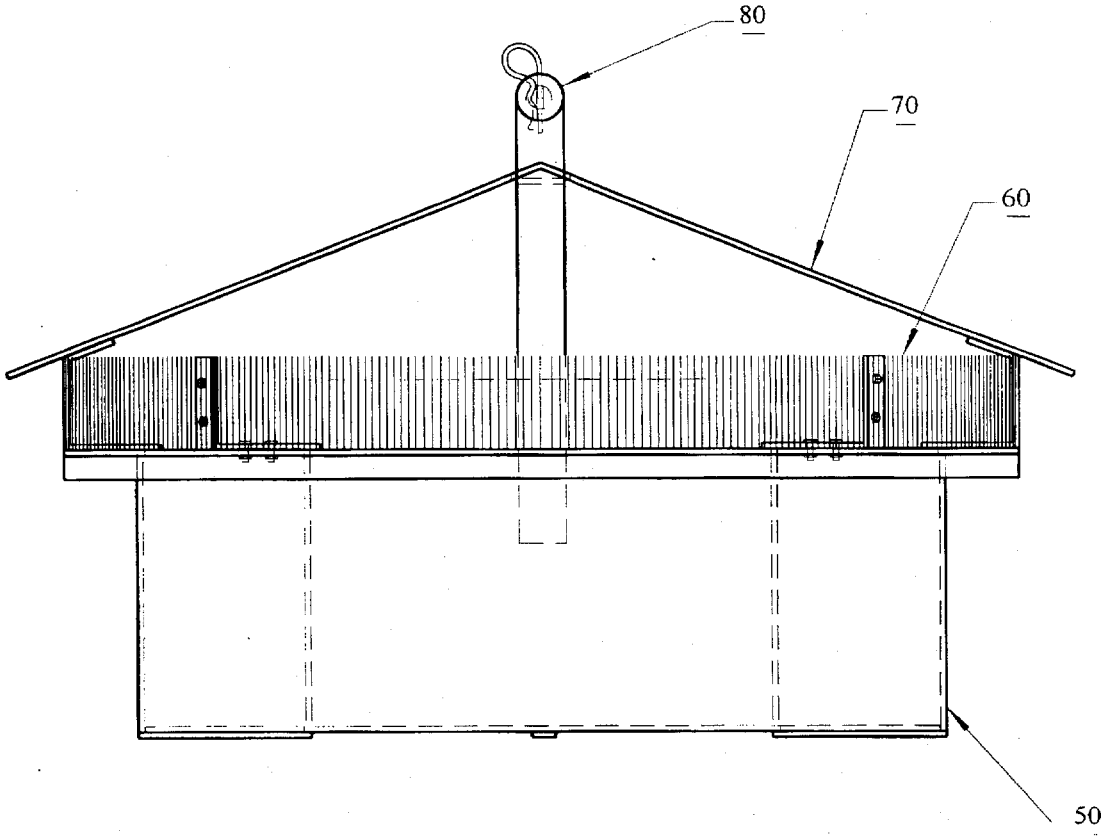
FIG. 4 shows a front view of the fully assembled storm drain filter.

A typical embodiment of my storm drain filter consists of four primary components, as follows: (1) a filtration vessel 50; (2) a perforated lid/floatables screen 60; (3) a cover plate 70; and (4) a lift handle 80. The above-listed components are illustrated in exploded view in FIG. 1. A typical installation of my storm drain filter in a catch basin 90 and upon a standpipe 100 is illustrated in FIG. 2. Assembly of primary components 50, 60, 70, and 80 as illustrated in FIGS. 3 and 4, constitutes the current favored embodiment of my storm drain filter.

Figure 5A:
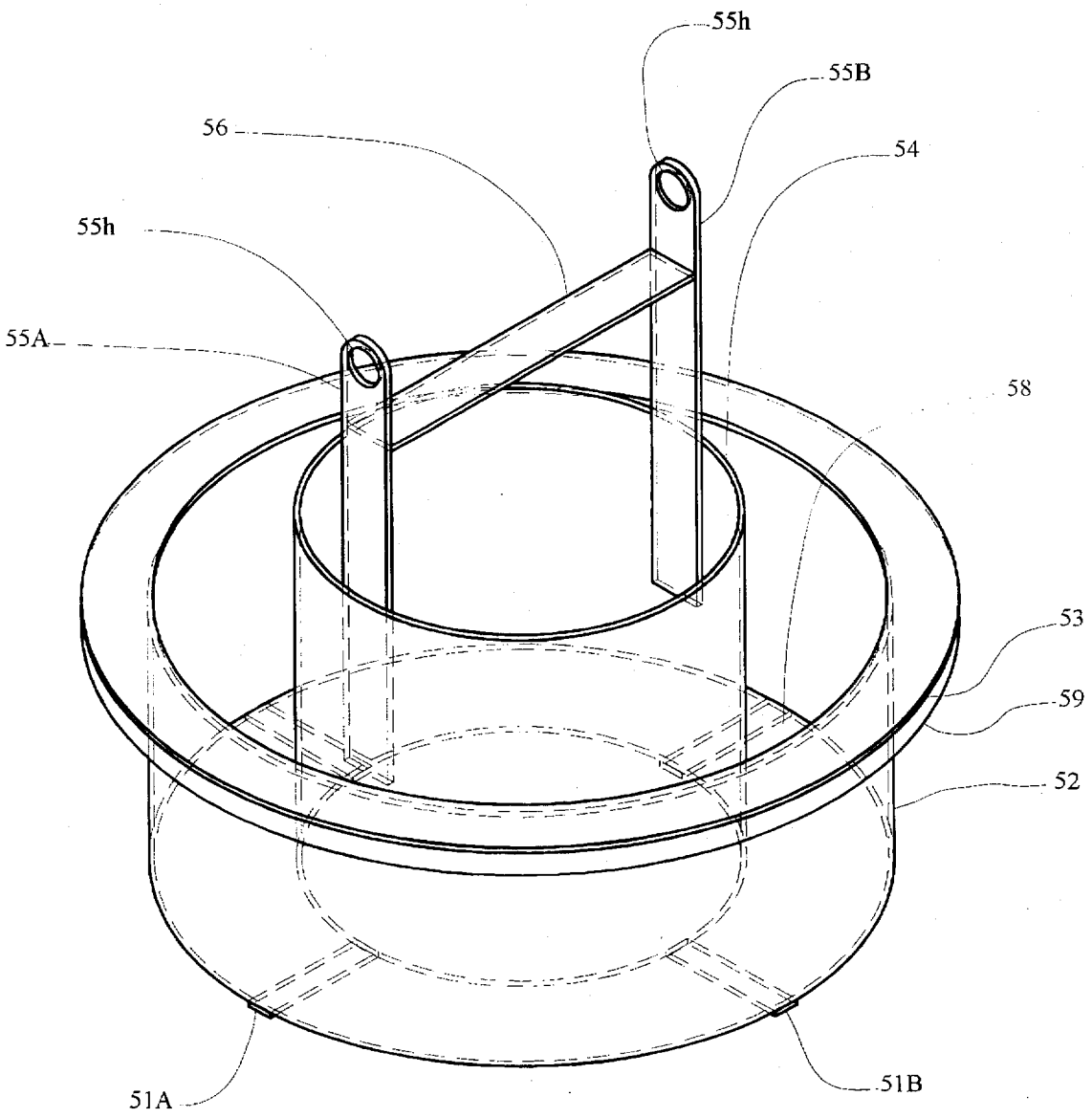
FIG. 5*a* shows an isometric view of the media containment vessel and flow conveyances.
Figure 5B:
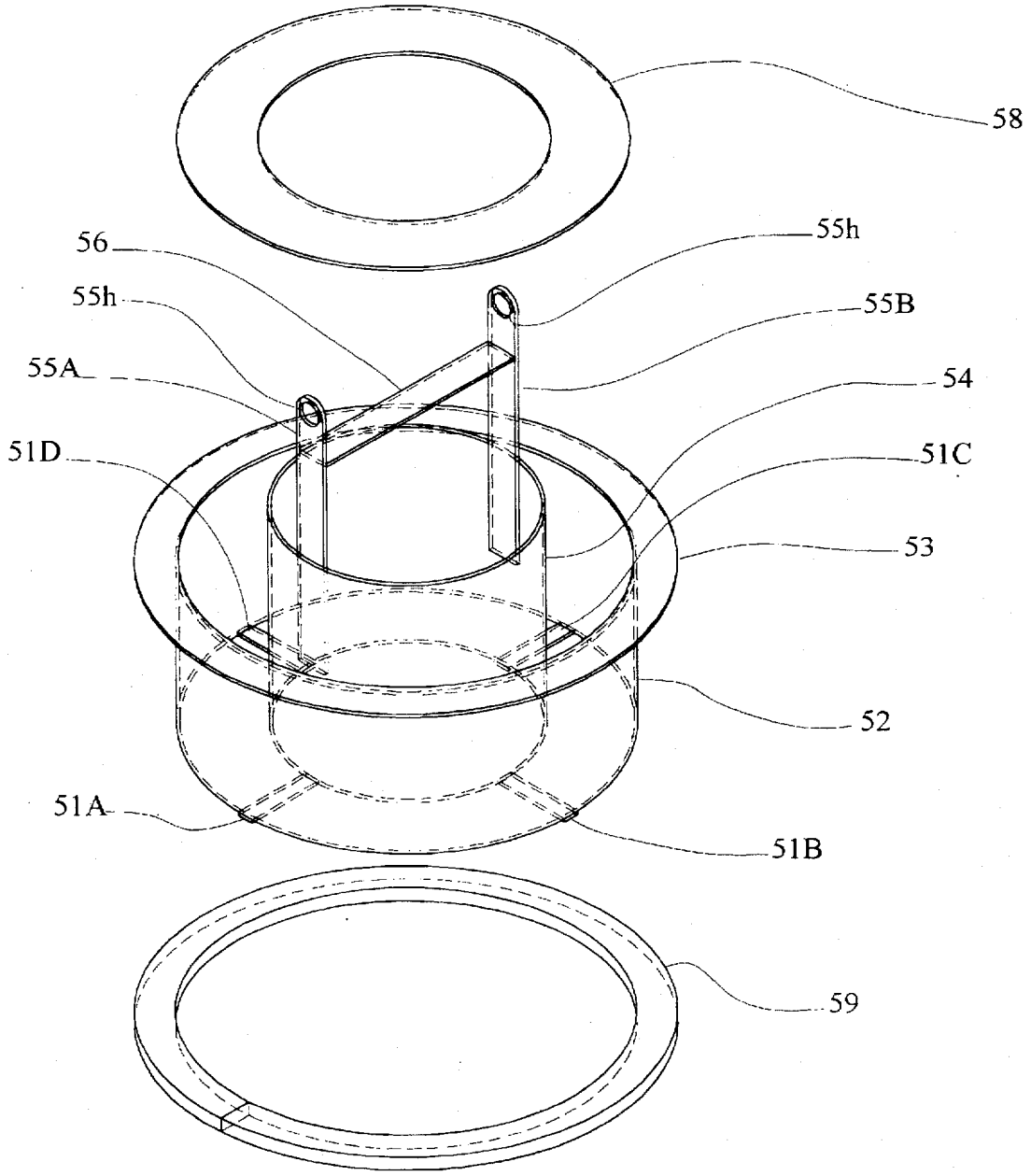
FIG. 5*b* shows an isometric view of the media containment vessel and flow conveyances, with some parts in exploded view.

Filtration vessel 50 is illustrated in FIG. 5*a*. Fabrication of filtration vessel 50 begins with assembly of components 51 through 56. Components 58 and 59 are added following assembly and galvanization of components 51 through 56. FIG. 5*b* illustrates filtration vessel 50 with components 58 and 59 in exploded view.

As shown in FIG. 5*a*, filtration vessel 50 includes two concentric cylinders, an outer cylinder 52 and an inner cylinder 54. Outer cylinder 52 is a section of schedule 10 steel pipe with length equal to 15.24 centimeters (6 inches), inner diameter (I.D.) equal to 39.37 centimeters (15½ inches), and outer diameter (O.D.) equal to 40.64 centimeters (16 inches). Inner cylinder 54 is a section of schedule 20 steel pipe with length equal to 20.32 centimeters (8 inches), I.D. equal to 20.64 centimeters (8⅛ inches) and O.D. equal to 21.91 centimeters (8⅝ inches).

As shown in FIG. 5*b*, four equally spaced spokes 51A, 51B, 51C, and 51D span the radial gap between outer cylinder 52 and inner cylinder 54. Spokes 51A, 51B, 51C, and 51D are steel bars with square cross sections (6.35 millimeters×6.35 millimeters [¼ inch×¼ inch]), and length equal to 10.00 centimeters (3 15/16 inches). Spokes 51A, 51B, 51C, and 51D are placed at 90 degree intervals, and provide a connection between outer cylinder 52 and inner cylinder 54. Spokes 51A, 51B, 51C, and 51D fix the bottom edges of outer cylinder 52 and inner cylinder 54 to a common plane. Gas metal arc welds fix the points of contact between spokes 51A, 51B, 51C, and 51D and outer cylinder 52 and inner cylinder 54. With spokes 51A, 51B, 51C, and 51D in place, the top edge of inner cylinder 54 extends approximately 5.08 centimeters (2 inches) beyond the top edge of outer cylinder 52.

As shown in FIGS. 5*a* and 5*b*, a circular collar 53 is fixed upon on the top edge of outer cylinder 52. Circular collar 53 is fabricated from 10-gauge sheet metal, has an I.D. of 39.37 centimeters (15½ inches) and an O.D. of 50.80 centimeters (20 inches). Circular collar 53 is bonded to the peripheral wall of outer cylinder 52 by gas metal arc welds (2.54 centimeters [1 inch] in length, 7.62 centimeters [3 inches] on-center) located on the underside of circular collar 53.

As shown in FIGS. 5*a* and 5*b*, an assembly of steel bars 55A, 55B, and 56 is attached to inner cylinder 54. Steel bars 55A, 55B, and 56 have thickness equal to 3.18 millimeters (⅛ inch), and width equal to 2.54 centimeters (1 inch). Vertical bars 55A and 55B are 21.59 centimeters (8½ inches) in length, and extend 5.08 centimeters (2 inches) into inner cylinder 54 (downward from the top edge of inner cylinder 54), and are diametrically positioned. Vertical bars 55A and 55B are rounded at one end. The rounded portion of vertical bars 55A and 55B constitutes a half circle, with radius equal to 1.27 centimeters (½ inch), centered 1.27 centimeters (½ inch) from the end of the bar. Vertical bars 55A and 55B have a circular hole 55*h* at one end. Holes 55*h* have radius equal to 6.35 millimeters (¼ inch), and are centered 1.27 centimeters (½ inch) from the end of the bar. Vertical bars 55A and 55B are fixed to the inner wall of inner cylinder 54 by means of gas metal arc welds along the edges of contact between vertical bars 55 and inner cylinder 54. Horizontal bar 56 is cut to fit between vertical bars 55A and 55B. Horizontal bar 56 is placed horizontally between vertical bars 55A and 55B so that the top of horizontal bar 56 is 16.00 centimeters (6.3 inches) above the downward end (square end) of vertical bars 55A and 55B. Horizontal bar 56 is fixed to vertical bars 55A and 55B by means of gas metal arc welds on the underside of horizontal bar 56, along the edges of contact.

The assembly of components 51, 52, 53, 54, 55A, 55B, and 56, as shown in FIG. 5*b*, is hot-dipped galvanized for corrosion protection.

As shown in FIG. 5*b*, perforated bottom 58 is inserted into the galvanized assembly (components 51 through 56), and placed upon spokes 51A, 51B, 51C, and 51D. Perforated bottom 58 is made from a 16-gauge perforated stainless steel (with round perforations and staggered centers). The perforations have diameter equal to 2.38 millimeters (3/32 inch), with centers staggered at 3.97 millimeters (5/32 inch) at 60-degrees. Perforated bottom 58 has an I.D. of 22.23 centimeters (8¾ inches) and an O.D. of 39.05 centimeters (15⅜ inches).

Following assembly and galvanization of components 51 through 56, gasket 59 is fixed to the underside of circular collar 53, as shown in FIG. 5*a*. Gasket 59 is a flexible rubber gasket with dimensions equal to 1.27 centimeters (½ inch) thick and 4.45 centimeters (1¾ inch) wide. The length of gasket 59 is equal to the circumference of the peripheral edge of circular collar 53. Gasket 59 is fixed to the underside of circular collar 53 by means of a water resistant contact cement that adheres to rubber and metal (applied in accordance with the manufacturer's instructions for proper use). The seam, where the ends of gasket 59 come together, must be tight with no gaps.

Figure 6A:
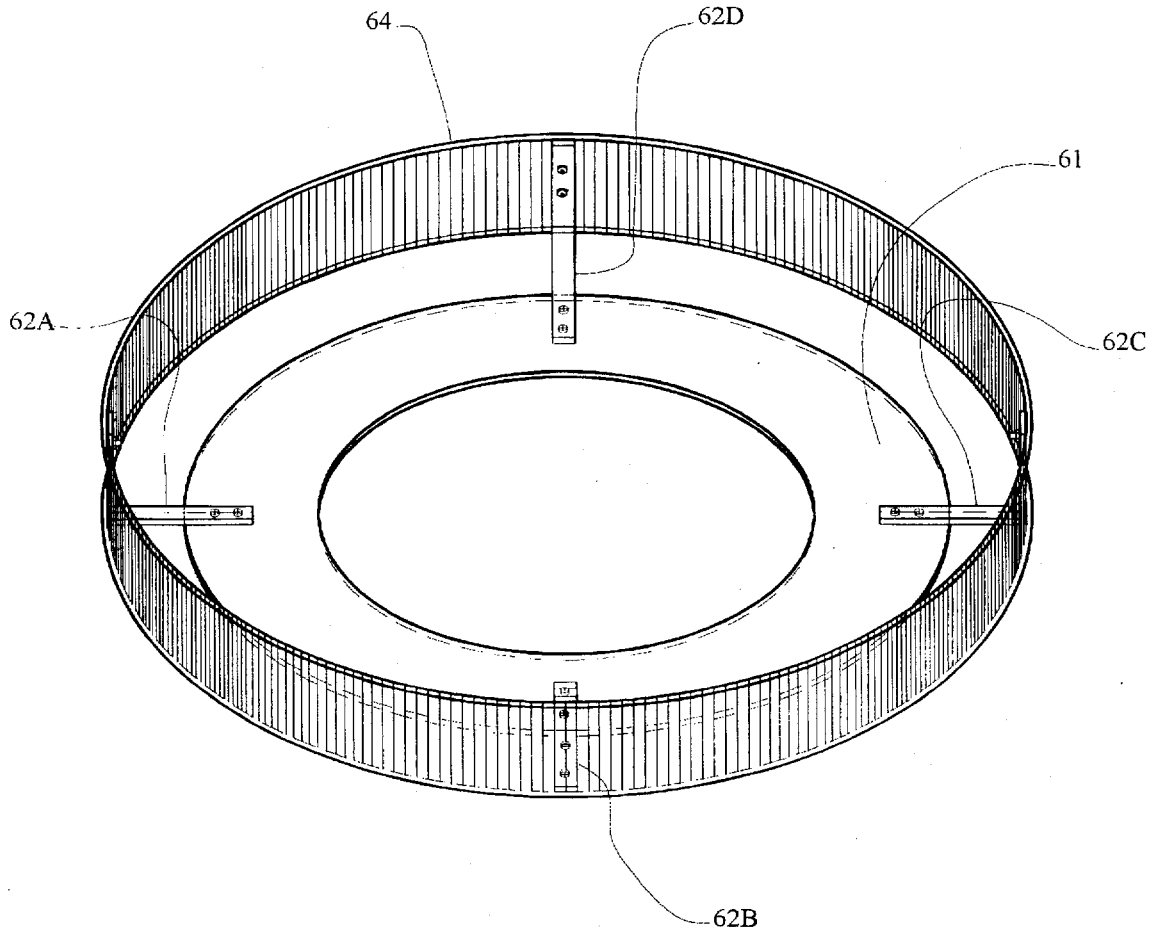
FIG. 6*a* shows an isometric view of the filter lid.

Perforated lid/floatables screen 60 is illustrated in FIG. 6*a*. Floatables screen 64 is made from a sheet of flattened expanded metal (stainless steel) with dimensions equal to 6.35 centimeters (2½ inches) wide by 163.20 centimeters (64¼ inches) long. Floatables screen 64 has diamond shaped openings with opening dimensions equal to 3.05 millimeters (0.120 inches) wide and 1.58 centimeters (0.620 inches) long. Floatables screen 64 is cut so that the long axis of the diamond shaped openings is parallel to the 6.35 centimeter (2.5 inch) width. Perforated lid 61 is made from 16-gauge perforated stainless steel (with round perforations and staggered centers). The perforations have diameter equal to 2.38 millimeters (3/32 inch), with centers staggered at 3.97 millimeters (5/32 inch) at 60-degrees. Perforated lid 61 has an I.D. of 22.23 centimeters (8¾ inches) and an O.D. of 39.05 centimeters (15⅜ inches).

Figure 6B:
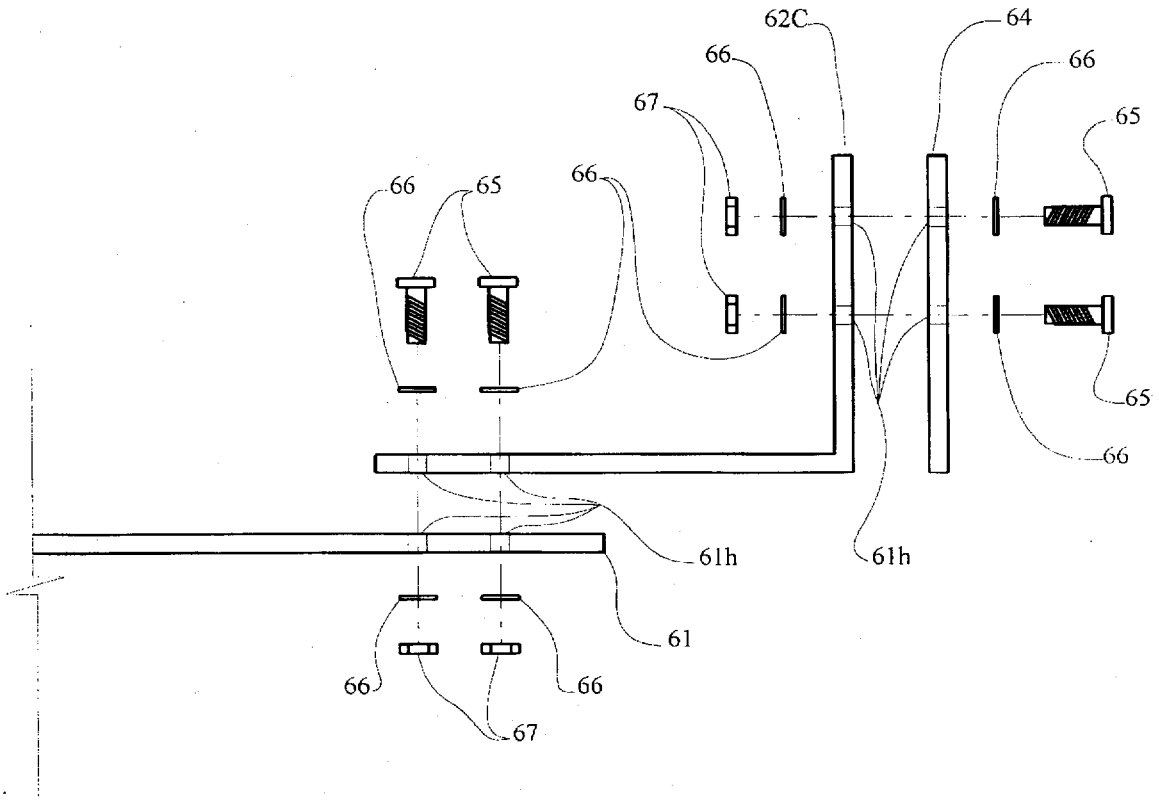
FIG. 6*b* shows a detailed view of the attachment hardware for the floatables screen.

As illustrated in FIG. 6*a*, four screen supports 62A, 62B, 62C, and 62D are attached to perforated lid 61 and to floatables screen 64. Screen supports 62A, 62B, 62C, and 62D are positioned at 90 degree intervals along the peripheral edge of perforated lid 61. Screen supports 62A, 62B, 62C, 62D are made from steel bar having thickness equal to 3.18 millimeters (⅛ inch), and width equal to 1.27 centimeters (½ inch). A detailed view of screen supports 62A, 62B, 62C, and 62D is provided in FIG. 6*b*. The horizontal portion of screen supports 62A, 62B, 62C, and 62D (contact with perforated lid 61) is 10.16 centimeters (4 inches) long. The vertical portion of screen supports 62A, 62B, 62C, and 62D (contact with floatables screen 64) is 6.35 centimeters (2½ inches) long. The angle between the horizontal portion and the vertical portion is equal to 90.0 degrees. Screen supports 62A, 62B, 62C, and 62D are hot-dipped galvanized for corrosion protection. Following galvanization, screen supports 62A, 62B, 62C, and 62D are positioned to extend 6.03 centimeters (2⅜ inches) beyond the peripheral edge of perforated lid 61. As shown in FIG. 6*b*, two bolt holes 61*h*, with diameters equal to 3.97 millimeters (5/32 inch), are drilled through each screen support 62 and through perforated lid 61. Bolt holes 61*h* are drilled so that distance between the peripheral edge of perforated lid 61 and the nearest bolt hole 61*h* is 1.27 centimeters (½ inch). Screen supports 62A, 62B, 62C, and 62D are attached to lid 61 by means of stainless steel pan-head phillips machine screws 65, stainless steel lock washers 66, and stainless steel hex nuts 67, as shown in FIG. 6*b*. Screws 65 have head diameter equal to 6.35 millimeters (¼ inch), shank diameter equal to 3.18 millimeters (⅛ inch), and shank length equal to 7.94 millimeters (5/16 inch). Washers 66 and nuts 67 are sized to match.

Floatables screen 64 is wrapped around the exterior of screen supports 62A, 62B, 62C, and 62D to form a cylindrical shape with I.D. equal 51.12 centimeters (20⅛ inches), as shown in FIG. 6*a*. The ends of floatables screen 64 are brought together to overlap on one of the screen supports 62. Floatables screen 64 is attached to screen supports 62A, 62B, 62C, and 62D as shown in FIG. 6*b*. Two bolt holes 61*h* are drilled through each screen support 62 at locations that match openings in floatables screen 64. Floatables screen 64 is attached to screen supports 62A, 62B, 62C, and 62D by means of screws 65, washers 66, and nuts 67 (see above for dimensions).

Figure 7A:
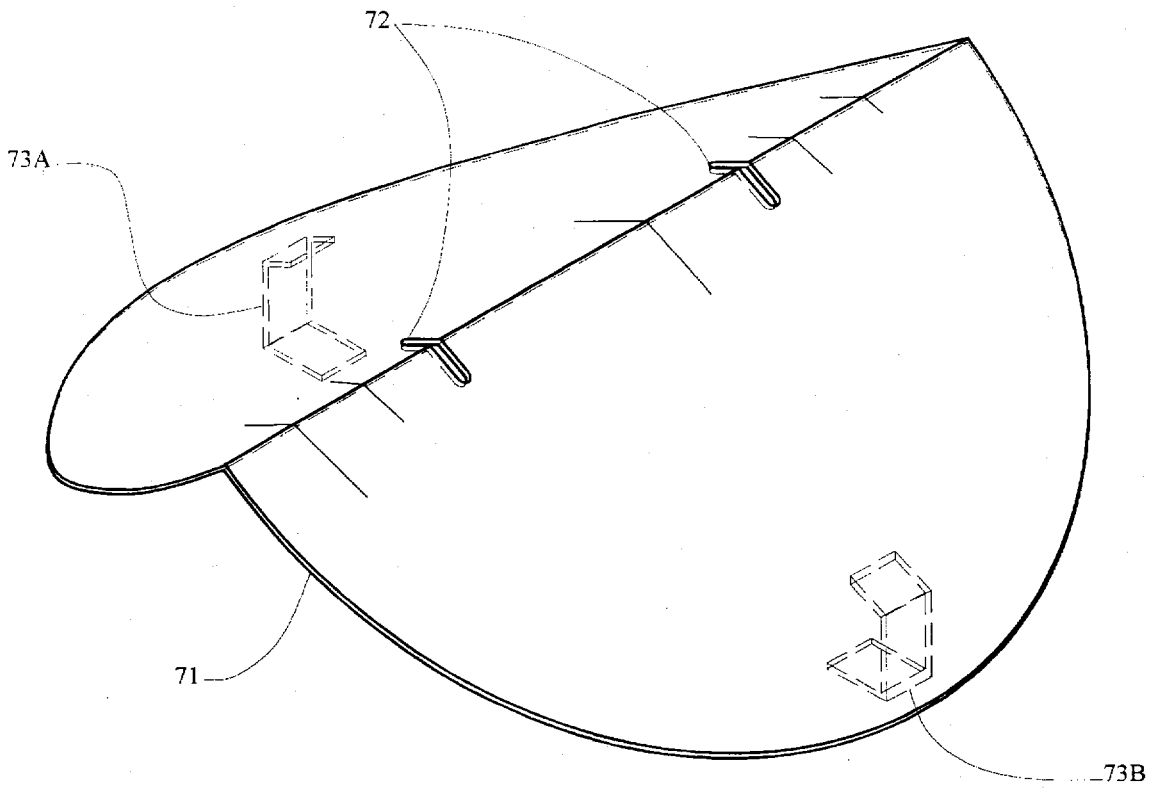
FIG. 7*a* shows an isometric view of the filter cover plate.
Figure 7B:
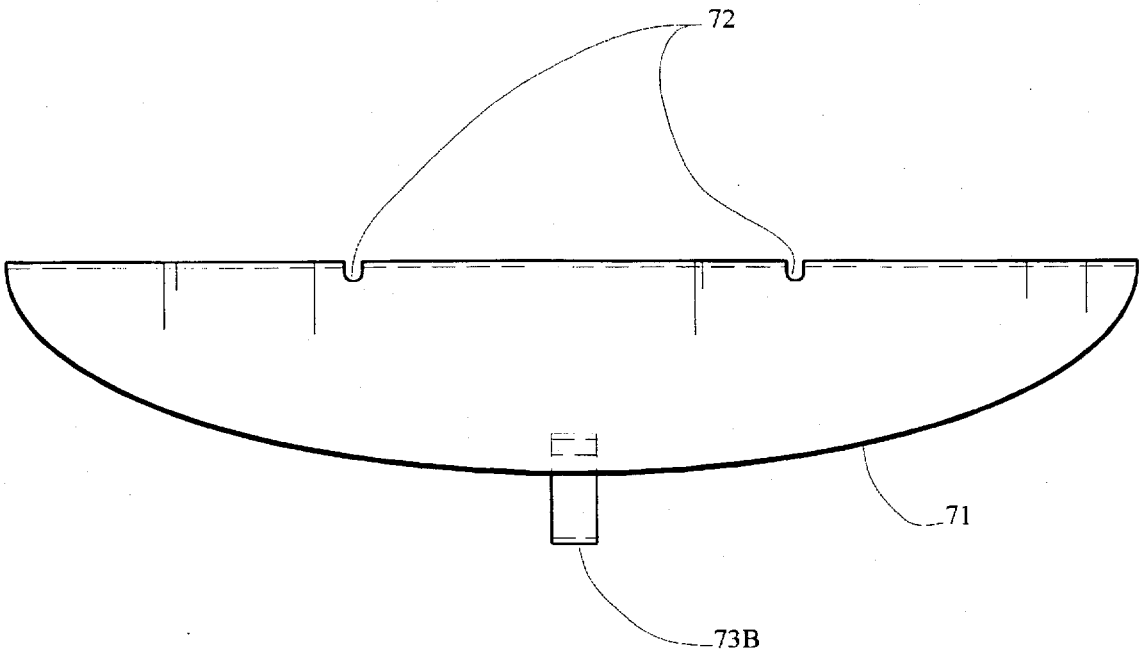
FIG. 7*b* shows a side view of the filter cover plate.

Cover plate 70 is illustrated in FIG. 7*a*. Plate 71 is fabricated from a circular plate (10-gauge sheet metal) with diameter equal to 58.42 centimeters (23 inches). The circular plate is bent along a center axis to create an interior angle of 136.4 degrees, as shown in FIG. 7*c*.

Cuts are made in plate 71 to create apertures 72, as shown in FIG. 7*a*. Apertures 72 are 9.53 millimeters (⅜ inches) wide and 3.18 centimeters (1¼ inches), and are symmetrical about the axis of the bend. The center point of apertures 72 is located 9.84 centimeters (3⅞ inches) from the midpoint of the axis of the bend.

Figure 7C:
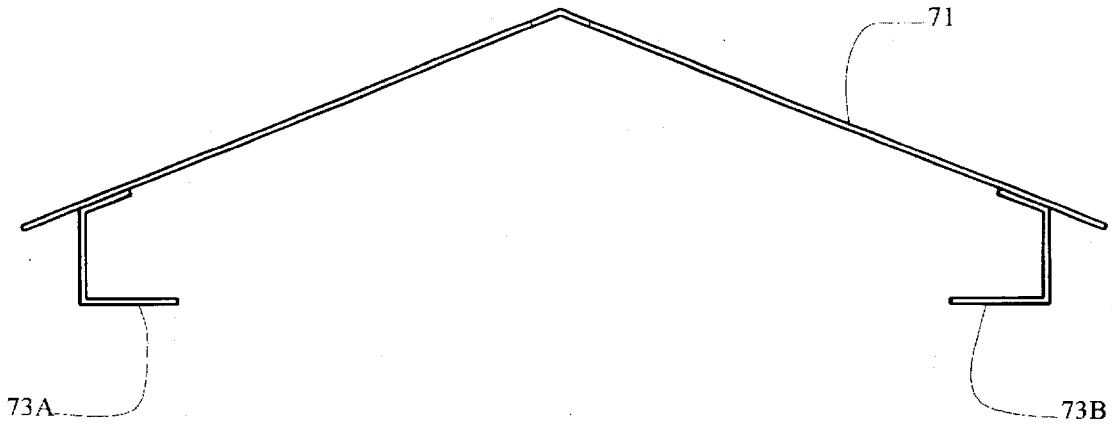
FIG. 7*c* shows a front view of the filter cover plate.

As shown in FIG. 7*c*, two cover plate supports 73A and 73B are fixed to plate 71. Cover plate supports 73A and 73B are fabricated from steel bar having thickness equal to 3.18 millimeters (⅛ inch), and width equal to 2.54 centimeters (1 inch). The bottom (horizontal) portion of cover plate supports 73A and 73B is 6.35 centimeters (2½ inches) long. The side (vertical) portion of cover plate supports 73A and 73B is 6.35 centimeters (2½ inches) long. The top (angled) portion of cover plate supports 73A and 73B is 2.54 centimeters (1 inch) long. The interior angle between the vertical and angled portion is 111.8 degrees. The interior angle between the horizontal portion and vertical portion is 90 degrees.

Cover plate supports 73A and 73B are positioned on the underside of plate 71 as shown in FIGS. *7a* and *7c*. Cover plate supports 73A and 73B are fixed to the underside of plate 71 by means of gas metal arc welds along the edges of contact. Cover plate supports 73A and 73B are placed on both sides of, and equidistant from the bend in plate 71. The horizontal distance between the vertical sides (closest to the peripheral edge of plate 71) of cover plate supports 73A and 73B is 50.80 centimeters (20 inches). Cover plate assembly 70 is hot-dipped galvanized for corrosion protection.

Figure 8:
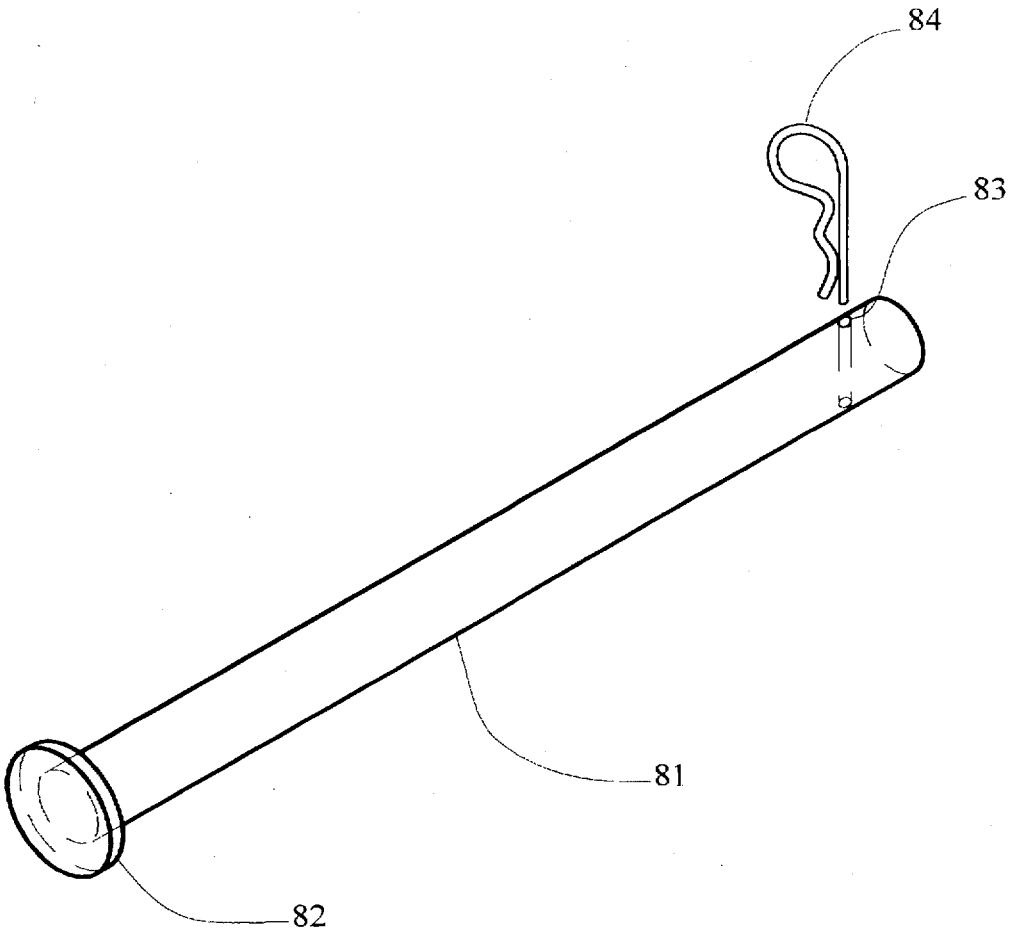
FIG. 8 shows an isometric view of the filter handle.

Lift handle 80 is illustrated in FIG. 8. Lift handle 80 includes a steel rod 81. Rod 81 is a steel rod with length equal to 22.23 centimeters (8¾ inches), and diameter equal to 9.53 millimeters (⅜ inch). End washer 82 has hole diameter less than 9.53 millimeters (⅜ inch), outer diameter equal to 2.54 centimeters (1 inch), and thickness equal to 1.59 millimeters (1/16 inch). End washer 82 is welded through the washer hole to the end of rod 81. Clip hole 83 is drilled through rod 81. Clip hole 83 is centered 6.35 millimeters (¼ inch) from the end of rod 81, opposite end washer 82, and has diameter equal to 3.18 millimeters (⅛ inch). The assembly of components 81, 82, and 83 is hot-dipped galvanized for corrosion protection. Clip hole 83 may need re-drilling following the galvanization process. Clip 84 is a steel pin (cotter pin or as shown) with diameter less than 3.18 millimeter (⅛ inch).

Figure 9:
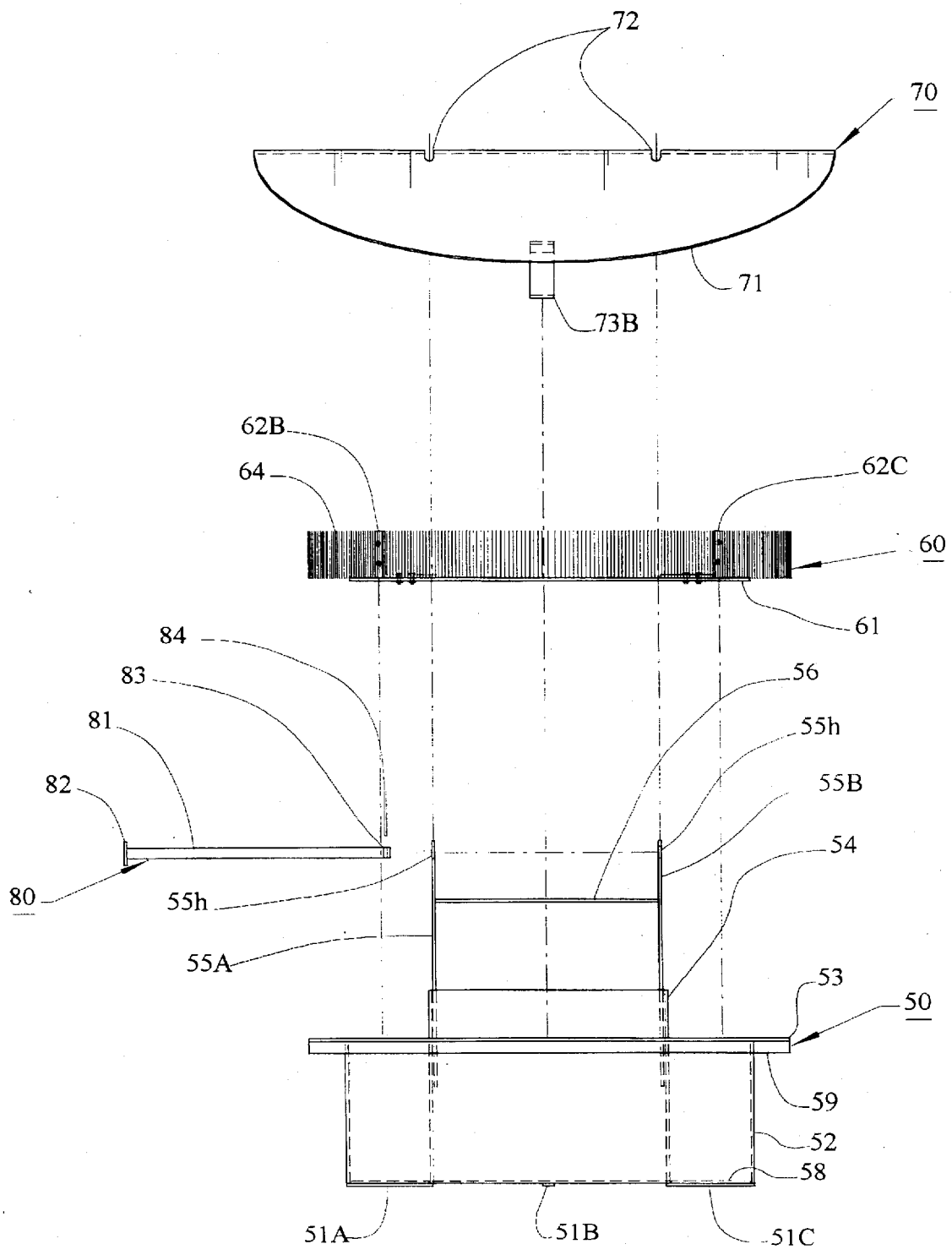
FIG. 9 shows an exploded, side view of the storm drain filter.

Components 50, 60, 70 and 80 are assembled as follows (FIG. 9): (1) perforated lid/floatables screen 60 is placed on top of filtration vessel 50, so that screen supports 62A, 62B, 62C, and 62D rest upon circular collar 53, and inner cylinder 54 protrudes approximately 5.08 centimeters (2.0 inches) above perforated lid 61; (2) cover plate 70 is placed on top of perforated lid/floatables screen 60 (on top of filtration vessel 50), so that cover plate supports 73A and 73B rest upon circular collar 53 and perforated lid 61, and vertical bars 55A and 55B extend through apertures 72; (3) lift handle 80 is attached to filtration vessel 50 by sliding rod 81 through holes **55*h*; and (5) clip 84 is inserted through clip hole 83 to lock lift handle 80 onto the filtration vessel 50**.

OPERATION

Figure 10:
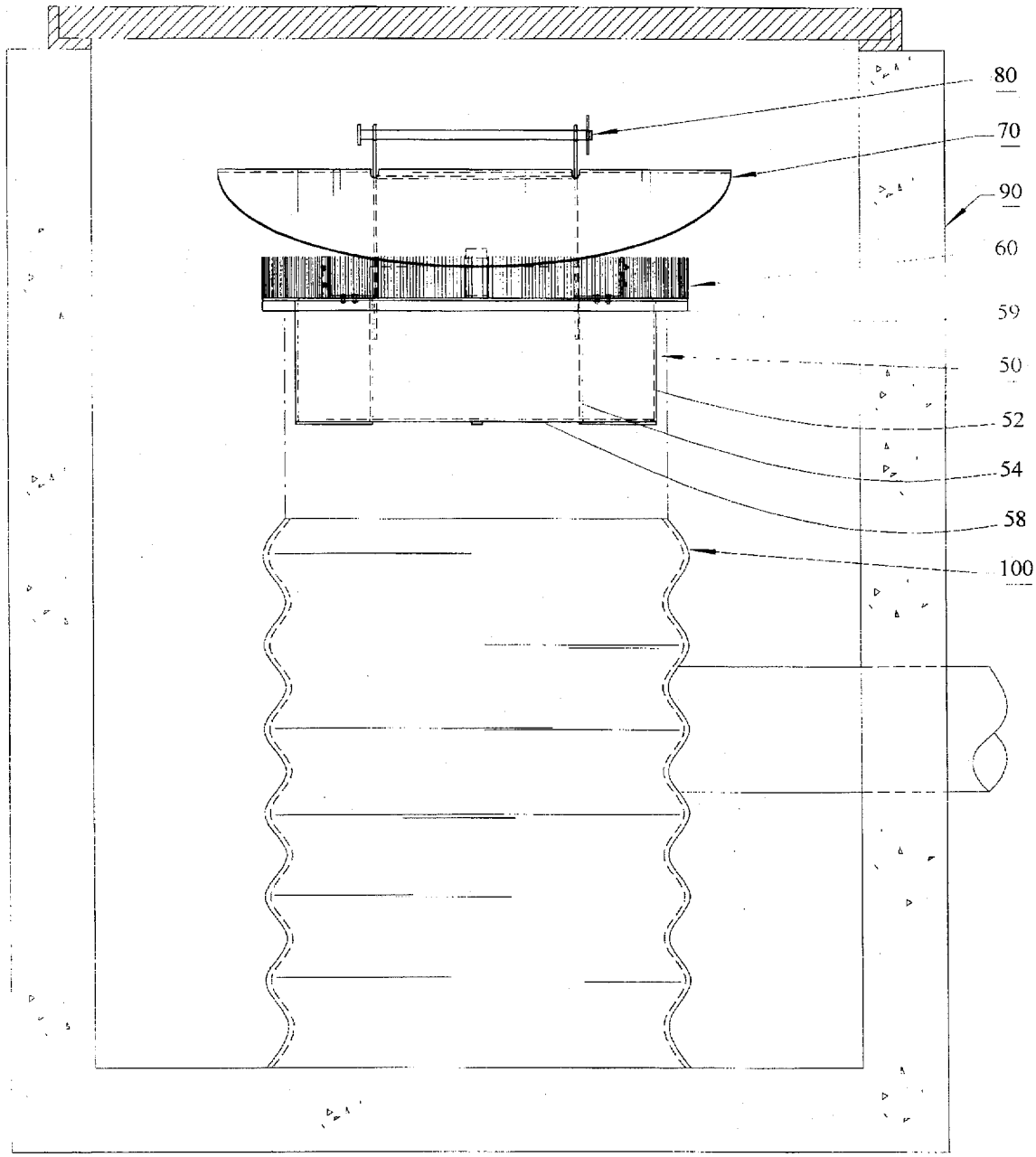
FIG. 10 shows a typical installation of the fully assembled storm drain filter in a catch basin.

FIGS. 2, and 10

The primary goal of my storm drain filter is to improve the quality of storm water/urban runoff by enhancing sedimentation and the removal of oil and grease within a catch basin. To accomplish this goal, and as shown in FIGS. 2 and 10, my storm drain filter is used in combination with other structures including a catch basin with grated inlet 90 and standpipe outlet 100. In addition, an absorbent media must be placed within filtration vessel 50. A typical installation of my storm drain filter proceeds as follows:

(1) An absorbent hydrophobic and oleophylic media is placed within filtration vessel 50, prior to the placement of floatables screen/perforated lid 60 and cover plate 70. The media is placed on top of perforated bottom 58, between inner cylinder 54 and outer cylinder 52, to an approximate depth of 12.7 centimeters (5 inches).

(2) Perforated lid/floatables screen 60 is placed on top of filtration vessel 50, so that screen supports 62A, 62B, 62C, and 62D rest upon circular collar 53, and inner cylinder 54 protrudes approximately 5.08 centimeters (2.0 inches) above perforated lid 61.

(3) Cover plate 70 is placed on top of perforated lid/floatables screen 60 (on top of filtration vessel 50), so that cover plate supports 73A and 73B rest upon circular collar 53 and perforated lid 61, and vertical bars 55A and 55B extend through apertures 72.

(4) Lift handle 80 is attached to filtration vessel 50, by sliding rod 81 through holes **55*h***.

(5) Clip 84 is inserted through clip hole 83 to lock lift handle 80 onto the filtration vessel 50.

(6) As shown in FIG. 10, the fully assembled storm drain filter is placed below the grated inlet to a catch basin 90. Catch basin 90 can vary in shape and size, but must be sized to allow placement of a vertical standpipe 100 (≈45.72 centimeters [≈18 inch] diameter), outlet pipe (s), and the storm drain filter. Placement of my storm drain filter is accomplished by holding lift handle 80, and lowering the filter into standpipe 100 until filtration vessel 50 is supported by the top edge of the standpipe 100, and gasket 59 seals the contact between the invention and standpipe 100. The weight of the storm drain filter (approximately 50 pounds) provides the downward force necessary to hold the filter in place. To accommodate the current favored embodiment, standpipe 100 must have an inner diameter greater than 40.64 centimeters (16 inches), and less than 45.72 centimeters (18 inches). The upper edge of standpipe 100 must be level, relatively smooth, and the distance between the upper edge of standpipe 100 and the underside of the grated inlet must be at least 22.86 centimeters (9 inches). The standpipe is constructed to pond water within the catch basin 90. Catch basin 90 should be sized to provide sedimentation and sediment storage within the catch basin (outside the standpipe 100).

During a runoff event, storm water/urban runoff enters the grated inlet to the catch basin 90. Runoff falls through the grated inlet and onto cover plate 70. Cover plate 70 diverts runoff, and any sediment contained in the runoff, away from filtration vessel 50 and into an area where sedimentation can occur (outside standpipe 100). Cover plate 70 prevents the direct deposition of sediment onto the perforated lid 61 and dissipates kinetic energy of influent water. The standpipe outlet 100, as opposed to the traditional side wall outlet, provides for a more stagnant settling zone within the catch basin and prevents re-suspension of accumulated sediment.

During a runoff event, storm water/urban runoff will accumulate within catch basin 90. When the volume of runoff exceeds the storage volume of catch basin 90 (minus the volume occupied by standpipe 100), the water surface elevation will rise above circular collar 53 of filtration vessel 50. Runoff will then flow through perforated lid/floatables screen 60. Perforated lid/floatables screen 60 has two main functions: (1) to prevent floatables such as leaves, pine needles, cigarette butts from accumulating on the perforated lid; and (2) to evenly distribute the runoff to the absorbent media. Runoff that passes through perforated lid/floatables screen 60 comes into contact with the absorbent media. Following contact with the absorbent media, runoff flows out of filtration vessel 50. The treated flow then exits standpipe 100 through the outlet pipe(s) to an appropriate disposal location (such as an infiltration structure, or retention basin).

Under high flow conditions, the flow rate into the catch basin 90 may exceed the flow capacity through perforated lid/floatables screen 60 and/or through the absorbent media. Under these conditions, water will pond above perforated lid/floatables screen 60 until the water elevation rises above the top edge of inner cylinder 54. The ponded water will then overflow through inner cylinder 54 and to the outlet pipe. This configuration prevents the accumulation of excessive pressure head upon the absorbent media.

My storm drain filter will require periodic maintenance, primarily to recharge the absorbent media. The frequency of maintenance will depend on site conditions (pollutant loading). To maintain my storm drain filter, one would remove the catch basin grate, grab the filter by lift handle 80, lift the filter out of catch basin 90, remove cover plate 70, remove perforated lid/floatables screen 60, dump out the used media, clean off perforated bottom 58, add new media, re-assemble, return the filter to standpipe 100, and install the grate. Used media must be disposed of properly, and in accordance with all applicable rules and regulations. In addition, accumulated sediment within the catch basin should be removed periodically.

Conclusion, Ramifications, and Scope of Invention

Thus the reader will see that my storm drain filter, and its method of use, provide a highly reliable, durable, and effective means to enhance sedimentation and to remove oil and grease within a catch basin. Several of the problems encountered with existing storm drain filters (also referred to as catch basin inserts) are eliminated, or at least significantly reduced, by the present design and method of use. My storm drain filter provides: (1) sedimentation prior to passing storm water through absorbent media; (2) dissipation of energy away from the absorbent media; (3) a true bypass that permits the passage of high flows without disruption of the absorbent media; (4) hydraulic control to prevent scouring of absorbent media; and (5) protection of accumulated sediments within the catch basin sump. In addition, my storm drain filter is easy to install, remove, and maintain by a human being without special equipment.

While my above description contains many specificities, these should not be construed as limitations on the scope of this storm drain filter, but rather as an exemplification of one preferred embodiment thereof. Many other variations are possible. For example all components of my storm drain filter can be made of materials other than those listed in the specification, including: stainless steel, reinforced fiberglass, and plastic. Injection molding of plastic to form the invention can eliminate the number of individual components (for example, components 51 through 58 of the filtration vessel 50 can be formed as a singular plastic body). Means other than hot-dip galvanization can be used to provide a corrosion resistant coating. The dimensions of the storm drain filter can be modified to provide a range of sizes to accommodate different flow/treatment requirements. The perforation sizes and shapes in the perforated bottom 58 and lid 61 can vary to accommodate a range of media types. In fact, a media cartridge (containing absorbent media) to be inserted into filtration vessel 50 can be substituted for particulate media. The mesh size provided by floatables screen 64 can vary is size and shape. Perforated bottom 58 can be installed in such a manner as to provide the structural connection between outer cylinder 52 and inner cylinder 54, and thereby eliminate spokes 51A, 51B, 51C, and 51D. Provided vertical bars 55A and 55B have adequate rigidity and strength, cross member 56 can be eliminated. The inner and outer cylinders 54 and 52 can be fabricated from sheets of material as an alternate to pipe sections. In addition, a means other than gravity, such as an attachment clamp, can be employed to secure the filter upon a standpipe. Media types, other than that prescribed in the preferred embodiment (hydrophobic, oleophylic), can be used to remove pollutants other than oil and grease.

Accordingly, the scope of my storm drain filter should not be determined by the embodiments illustrated, but by the appended claims and their legal equivalents.

I claim:

1. A removable storm drain filter to be used in combination with an absorbent media, and a catch basin having grated inlet and standpipe outlet, for purposes of removing pollutants carried in surface drainage, comprising:

(a) a filtration vessel for containing absorbent media, said filtration vessel having solid side walls, a perforated bottom, and a perforated lid;

(b) means for accessing said filtration vessel to permit inspecting and changing absorbent media;

(c) bracing means for supporting said filtration vessel upon a standpipe;

(d) sealing means for making a watertight seal between said bracing means and the standpipe;

(e) weir means for creating sufficient pressure head upon said perforated lid to force the passage of storm water through said filtration vessel, and for bypassing high flows without disruption of the absorbent media;

(f) a removable cover plate for dissipating kinetic energy of incoming storm water between the catch basin grated inlet and said filtration vessel, and for directing influent sediment away from said perforated lid;

(g) means for supporting and securing said cover plate above and upon said filtration vessel;

(h) floatables screen for preventing the accumulation of floating litter upon said perforated lid;

(i) means for supporting and securing said floatables screen upon said filtration vessel;

(j) means to facilitate installing, removing, and carrying the fully assembled apparatus by a human being;

whereby sedimentation, straining of floating litter, and dissipation of kinetic energy occur prior to contact with absorbent media so as to prevent clogging and scouring of media, and flow control is provided to prevent scouring of media even during high flows.

2. The apparatus of claim 1 wherein all elements are composed of a rust resistant, durable material.

3. The apparatus of claim 2 wherein said means to facilitate installing, removing, and carrying the fully assembled apparatus by a human being is a lift handle positioned above said cover plate and attached to said filtration vessel.

4. The apparatus of claim 3 wherein said perforated lid is removable.

5. The apparatus of claim 4 wherein the side walls of said filtration vessel are formed by an outer cylinder and an inner cylinder fixed in a concentric arrangement such that the space contained by said filtration vessel comprises the cylindrical space above said perforated bottom, between said outer cylinder and said inner cylinder, and below said perforated lid.

6. The apparatus of claim 5 wherein a top edge of said inner cylinder is fixed a predetermined distance above a top edge of said outer cylinder.

7. The apparatus of claim 6 wherein said bracing means is a circular collar that projects radially outward from, and at right angles to, a peripheral wall of said outer cylinder.

8. The apparatus of claim 7 wherein said sealing means is a flexible gasket fixed to an underside of said circular collar.

9. The apparatus of claim 8 wherein said cover plate comprises a circular plate bent along a diametric axis.

10. The apparatus of claim 9 wherein said means for supporting and securing said cover plate above and upon said filtration vessel comprises an assembly of rigid bars that project upward from said inner cylinder, and a plurality of supports fixed to an underside of said cover plate.

11. The apparatus of claim 10 wherein said floatables screen is attached to said perforated lid.

12. A method for enhancing sedimentation and the removal of pollutants inside a storm drain catch basin with grated inlet and interior walls, using a removable and rechargeable storm drain filter comprising a filtration vessel having solid side walls, a perforated bottom and a perforated lid surrounded by a flotables screen, the method comprising the steps of:

(a) placing an absorbent media within said filtration vessel;

(b) positioning said storm drain filter below a grated inlet to a catch basin, and upon an upward terminus of a standpipe;

(c) diverting surface drainage into the catch basin;

(d) dissipating kinetic energy of influent surface drainage below the grated inlet without disruption of the absorbent media;

(e) directing influent sediment to a settling zone comprising the space between a peripheral wall of the standpipe and the interior walls of the catch basin;

(f) causing surface drainage to accumulate inside the catch basin, between the peripheral wall of the standpipe and the interior walls of the catch basin;

(g) straining surface drainage through said flotables screen to prevent the accumulation of floating litter upon said perforated lid;

(h) decanting accumulated surface drainage from the space between the peripheral wall of the standpipe and the interior walls of the catch basin, through said perforated lid and then through the absorbent media;

(i) overflowing storm drainage flows that exceed the flow capacity through the absorbent media through an unobstructed conduit without disruption of the media;

(j) discharging treated surface drainage through a conduit extending from the standpipe to the point of disposal;

(k) removing said storm drain filter from the catch basin;

(l) removing and replacing spent media;

whereby sedimentation, straining of floating litter, and dissipation of kinetic energy occur prior to contact with absorbent media so as to prevent clogging and scouring of the media, and flow control is provided to prevent scouring of absorbent media even during high flows.

13. The method of claim 12 wherein accumulated sediment is removed periodically from the catch basin sump.

* * * * *